US011164531B2

(12) United States Patent
Fan et al.

(10) Patent No.: US 11,164,531 B2
(45) Date of Patent: Nov. 2, 2021

(54) DRIVE CIRCUIT FOR A DISPLAY PANEL HAVING A SLOT, DISPLAY SCREEN AND DISPLAY DEVICE

(71) Applicant: YUNGU (GU' AN) TECHNOLOGY CO., LTD., Langfang (CN)

(72) Inventors: Wenzhi Fan, Kunshan (CN); Zhengfang Xie, Kunshan (CN)

(73) Assignee: YUNGU (GU'AN) TECHNOLOGY CO., LTD., Langfang (CN)

( * ) Notice: Subject to any disclaimer, the term of this patent is extended or adjusted under 35 U.S.C. 154(b) by 0 days.

(21) Appl. No.: 16/850,028

(22) Filed: Apr. 16, 2020

(65) Prior Publication Data

US 2020/0243023 A1 Jul. 30, 2020

Related U.S. Application Data

(63) Continuation of application No. PCT/CN2019/080479, filed on Mar. 29, 2019.

(30) Foreign Application Priority Data

Sep. 19, 2018 (CN) ..... 201811095431.5

(51) Int. Cl.
*G09G 3/3291* (2016.01)
*G09G 5/10* (2006.01)

(52) U.S. Cl.
CPC ..... *G09G 3/3291* (2013.01); *G09G 5/10* (2013.01); *G09G 2300/0426* (2013.01)

(58) Field of Classification Search
CPC . G09G 3/3201; G09G 5/10; G09G 2300/0426
See application file for complete search history.

(56) References Cited

U.S. PATENT DOCUMENTS

2005/0099412 A1* 5/2005 Kasai ..... G09G 3/325 345/204
2008/0002130 A1* 1/2008 Kil ..... G02F 1/1345 349/149

(Continued)

FOREIGN PATENT DOCUMENTS

CN 102930813 A 2/2013
CN 103383835 A 11/2013

(Continued)

OTHER PUBLICATIONS

Search Report of International Application No. PCT/CN2019/082625.

(Continued)

*Primary Examiner* — Kent W Chang
*Assistant Examiner* — Chayce R Bibbee
(74) *Attorney, Agent, or Firm* — Kilpatrick Townsend & Stockton

(57) ABSTRACT

The exemplary embodiments of the present application provide a drive circuit for a display panel having a slot, a display screen and a display device. The drive circuit includes: a first drive line, for regulating luminous brightness of pixels in a row or column where the slot is located, and/or for regulating luminous brightness of pixels in a row or column adjacent to the slot; and a second drive line, for regulating luminous brightness of pixels in a row other than the row regulated by the first drive line, or for regulating luminous brightness of pixels in a column other than the column regulated by the first drive line; wherein, the currents or voltages applied to the first drive line and the second drive line are different.

17 Claims, 11 Drawing Sheets

(56) References Cited

U.S. PATENT DOCUMENTS

| | | | | |
|---|---|---|---|---|
| 2009/0213100 | A1* | 8/2009 | Watanabe | G09G 3/3659 345/205 |
| 2010/0053058 | A1 | 3/2010 | Nagashima et al. | |
| 2011/0109813 | A1* | 5/2011 | Toyomura | G09G 3/3233 348/739 |
| 2015/0310807 | A1 | 10/2015 | Sun et al. | |
| 2017/0110054 | A1 | 4/2017 | Sun et al. | |
| 2017/0256202 | A1 | 9/2017 | Sun | |
| 2018/0145093 | A1 | 5/2018 | Xi et al. | |
| 2018/0166017 | A1* | 6/2018 | Li | G09G 3/3233 |
| 2018/0226020 | A1 | 8/2018 | Wang et al. | |
| 2018/0315373 | A1 | 11/2018 | Wang et al. | |

FOREIGN PATENT DOCUMENTS

| | | | |
|---|---|---|---|
| CN | 104835453 | A | 8/2015 |
| CN | 105405397 | A | 3/2016 |
| CN | 105957473 | A | 9/2016 |
| CN | 106205491 | A | 12/2016 |
| CN | 106910463 | A | 6/2017 |
| CN | 107610645 | A | 1/2018 |
| CN | 107622749 | A | 1/2018 |
| CN | 107731153 | A | 2/2018 |
| CN | 107863061 | A | 3/2018 |
| CN | 109166520 | A | 1/2019 |

OTHER PUBLICATIONS

Written Opinion of International Application No. PCT/CN2019/082625.

First Office Action of Chinese Application No. 2018110954315.

Second Office Action of Chinese Application No. 2018110954315.

Office Action of Chinese Patent Application No. 2018110954315 dated May 7, 2020.

* cited by examiner

DRIVE CIRCUIT FOR A DISPLAY PANEL HAVING A SLOT, DISPLAY SCREEN AND DISPLAY DEVICE

CROSS-REFERENCES TO RELATED APPLICATIONS

The present application is a continuation of International Application No. PCT/CN2019/080479, filed on Mar. 29, 2019, which claims priority to Chinese Patent Application No. 201811095431.5, filed on Sep. 19, 2018. Both applications are incorporated by reference herein in their entireties for all purposes.

TECHNICAL FIELD

The exemplary embodiments of the present application relate to the field of display technology, and particularly relate to a drive circuit for a display panel having a slot, a display screen and a display device.

BACKGROUND

Along with the development of OLED display technology, OLED display screens are increasingly widely used, and the shapes of the screen bodies thereof are increasingly diversified. Slot design is a new technique, which may realize a higher screen area ratio and meanwhile may avoid certain functional elements. However, the slot design causes the problem of luminance non-uniformity (mura) of the display screen to become more severe.

SUMMARY

The exemplary embodiments of the present application provide a drive circuit for a display panel having a slot, a display screen and a display device.

One exemplary embodiment of the present application provides a drive circuit for a display panel having a slot, including a first drive line, for regulating luminous brightness of pixels in a row or column where the slot is located, and/or for regulating luminous brightness of pixels in a row or column adjacent to the slot; and a second drive line, for regulating luminous brightness of pixels in a row other than the row regulated by the first drive line, or for regulating luminous brightness of pixels in a column other than the column regulated by the first drive line; wherein, a current applied to the first drive line is different from a current applied to the second drive line, or a voltage applied to the first drive line is different from a voltage applied to the second drive line.

Optionally, when the display panel is scanned along a column direction of pixels, the first drive line is connected to pixels in the row where the slot is located and/or in the row adjacent to the slot.

Optionally, when the display panel is scanned along a row direction of pixels, the first drive line is connected to pixels in the column where the slot is located and/or in the column adjacent to the slot.

Optionally, the first drive line comprises at least two drive lines, the currents applied to the at least two drive lines are the same or different, or the voltages applied to the at least two drive lines are the same or different.

Optionally, the first drive line is a first initialization signal line, the second drive line is a second initialization signal line; the first initialization signal line is used for regulating the resetting of pixels in the row or column where the slot is located, and/or for regulating the resetting of pixels in the row or column adjacent to the slot; the second initialization signal line is used for regulating the resetting of pixels in a row other than the row regulated by the first initialization signal line, or for regulating the resetting of pixels in a column other than the column regulated by the first initialization signal line.

Optionally, the first initialization signal line and the second initialization signal line respectively receive a first initialization signal and a second initialization signal sent from a drive chip.

Optionally, the first drive line is a first gate control signal line, the second drive line is a second gate control signal line; the first gate control signal line is used for regulating the gate potential of pixels in the row or column where the slot is located, and/or for regulating the gate potential of pixels in the row or column adjacent to the slot; the second gate control signal line is used for regulating the gate potential of pixels in a row other than the row regulated by the first gate control signal line, or for regulating the gate potential of pixels in a column other than the column regulated by the first gate control signal line.

Optionally, the first gate control signal line and the second gate control signal line respectively receive a first gate control signal and a second gate control signal sent from a shift-register circuit.

Optionally, the current or voltage applied to the first drive line is a fixed value.

Optionally, the current or voltage applied to the first drive line is a variable value determined according to a gray scale.

Optionally, when the drive circuit comprises seven P-type metal oxide semiconductor thin-film-transistors and one capacitor and the first drive line is a first initialization signal line, the fixed value is in a range of −6V to 0V.

Optionally, the first drive line and the second drive line are formed in the same process step.

Optionally, the first drive line is formed in the same process step as a control end of a drive transistor or a switching transistor in a pixel connected with the first drive line; and/or the second drive line is formed in the same process step as a control end of a drive transistor or a switching transistor in a pixel connected with the second drive line.

Optionally, the first initialization signal line and the second initialization signal line are formed in the same process step.

Optionally, the first initialization signal line and the second initialization signal line are made of material selected from Mo, Al, Cu, Ti, ITO, IZO, Ag or Nb.

Optionally, the shift-register circuit is a Gate-in-Panel circuit.

Optionally, the second drive line comprises at least two drive lines, the currents applied to the at least two drive lines are the same or different, or the voltages applied to the at least two drive lines are the same or different.

Another exemplary embodiment of the present application provides a display screen, comprising: a display panel having a slot; and the drive circuit for a display panel according to any exemplary embodiment of the present application.

Optionally, the slot is located on an edge of the display panel.

Another exemplary embodiment of the present application provides a display device, comprising the afore-mentioned display screen.

The drive circuit for a display panel having a slot provided by the exemplary embodiments of the present application comprises a first drive line, for regulating luminous brightness of pixels in a row or column where the slot is located, and/or for regulating luminous brightness of pixels in a row or column adjacent to the slot; a second drive line, for regulating luminous brightness of pixels in a row other than the row regulated by the first drive line, or for regulating luminous brightness of pixels in a column other than the column regulated by the first drive line; a current applied to the first drive line is different from a current applied to the second drive line, or a voltage applied to the first drive line is different from a voltage applied to the second drive line. The afore-mentioned drive circuit utilizes the first drive line to regulate the luminous brightness of pixels in a row or column where the slot is located and/or regulate the luminous brightness of pixels in a row or column adjacent to the slot, and utilizes the second drive line to regulate the luminous brightness of pixels in other rows or columns, and by utilizing the first drive line to individually regulate the luminous brightness of pixels in and adjacent to the slot area on the display panel, the luminance of the entire display panel having the slot has good consistency, so that the uniformity of display is improved, and the problem of luminance non-uniformity (mura) of the display panel caused by the open slot is avoided.

BRIEF DESCRIPTION OF THE DRAWINGS

In order to more clearly describe the technical solutions in the exemplary specific embodiments of the present application, hereinafter, the appended drawings used for describing the specific embodiments will be briefly introduced. Apparently, the appended drawings described below are only some embodiments of the present application, and for a person with ordinary skill in the art, without expenditure of creative labor, other drawings can be derived from these appended drawings.

DETAILED DESCRIPTION OF THE INVENTION

Figure 1:
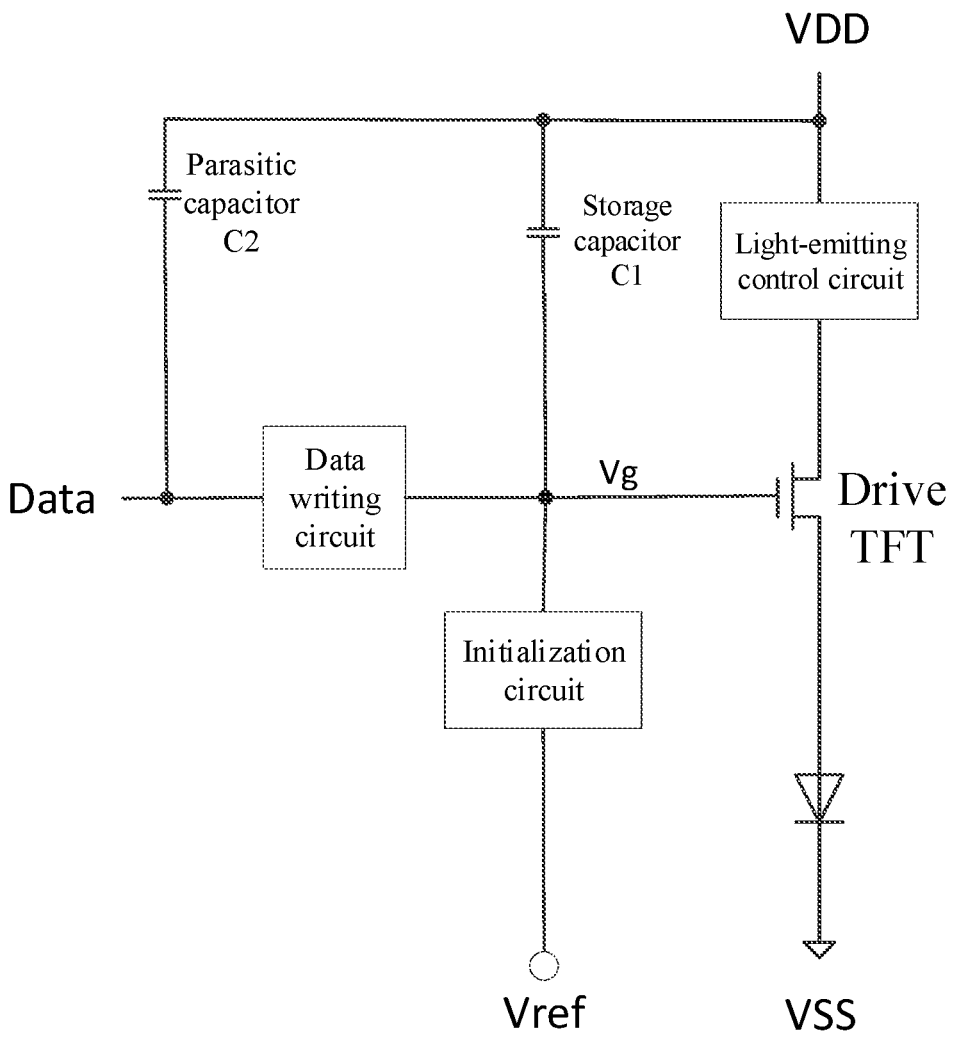
FIG. 1 is a schematic diagram of a pixel circuit in an exemplary embodiment of the present application.

In order to make the purpose, technical solution and advantages of the present application more clearly understood, hereinafter, with reference to the appended drawings and embodiments, the exemplary embodiments of the present application are further described in detail. It should be understood that, the specific embodiments described herein are only intended to explain the present application, not for restricting the present application.

A display panel with an open slot has a relatively severe problem of luminance non-uniformity (mura). The invertors' research has discovered that, an open slot would destroy the integral uniformity of the screen body and cause the capacitances of the signal lines and power lines in and adjacent to the slot area to be inconsistent with the capacitances of the signal lines and power lines in other locations of the display panel, and the voltage changes caused by the capacitive coupling thereof are different, which causes the luminous brightness of the slot area and the area adjacent thereto to be inconsistent with the luminous brightness of other locations of the display panel. Wherein, the problem of luminance non-uniformity (mura) is more severe at the joint between the slot area and the non-slot area. The slot area refers to the row(s) or column(s) where the slot is located; the area adjacent to the slot area refers to the row(s) or column(s) adjacent to the row(s) or column(s) where the slot is located.

Because the capacitances of the signal lines and power lines in and adjacent to the slot area are different from the capacitances of the signal lines and power lines in other locations of the display panel, the charging rate of the reset signal (initialization signal) charging the capacitor would be different, and the charging delay is also different; meanwhile, because the reset time of the display panel is limited, after being reset for a certain period of reset time, the resetting voltage for the pixels at the joint between the slot area and the non-slot area would be different from the resetting voltage for the pixels in other locations of the display panel, which influences the drive current of the organic light-emitting diodes (OLED) and thus influences the luminous brightness thereof. Therefore, by regulating the reset signal for pixels in and adjacent to the slot area, the luminous brightness of the pixels in and adjacent to the slot area can be rendered consistent with the luminous brightness in other locations of the display panel.

The reset capacitor in the pixel drive circuit may receive input of the reset signal, and the reset capacitor is connected to the gate electrode of the drive thin-film-transistor (TFT). Different reset signals would generate different gate resetting voltages. The gate resetting voltage influences the voltage Vgs between the gate electrode and the source electrode, and in turn influences the drive current of the drive TFT. Therefore, by changing the resetting voltage, the drive current for the pixels can be changed, and thus the luminous brightness of the pixels on the display panel can be regulated.

FIG. 1 is a schematic diagram of a pixel circuit, which is taken as an example to analyze how the initialization signal (reset signal) influences the luminous brightness of a pixel on a display panel. As shown in FIG. 1, firstly, the initialization circuit is turned on, the initialization signal voltage Vref is written into the gate electrode of the drive TFT. The gate voltage Vg equals the initialization voltage Vref, i.e., Vg=Vref. Then, the data writing circuit is turned on, the data signal is written into the gate electrode of the drive TFT, and the gate voltage of the drive TFT becomes Vdata.

Specifically, the data signal comes from a drive chip (drive IC) and through a capacitor and a resistor of the data line, and then is written into the gate electrode of the drive TFT through the data writing circuit. Therefore, there is time delay for the electric potential of the gate electrode to change from Vref to Vdata. In particular:

$$Vg=Vref+(Vdata-Vref)\times(1-\exp^{(-t/rc)}).$$

In the formula, r is an equivalent resistance on the data line, c is an equivalent capacitance on the data line (i.e., a sum of the storage capacitance C1 and the parasitic capacitance C2).

Then, the light-emitting control circuit is turned on, and the OLED device emits light. Because the current flowing through the OLED device equals the current flowing through the drive TFT which is controlled by the electric potential of the gate electrode, therefore, the luminous brightness of the OLED device is controlled by the electric potential of the gate electrode of the drive TFT. According to the above calculation formula, the electric potential of the gate electrode is influenced by the Vref signal, therefore, the current flowing through the OLED device is influenced by the Vref signal, and the luminous brightness of the pixel on the display panel is influenced by the Vref signal. That is to say, the initialization signal (reset signal) influences the luminous brightness of the pixel.

Moreover, because the capacitances of the signal lines and power lines in and adjacent to the slot area are different from the capacitances of the signal lines and power lines in other locations of the display panel, the voltage changes caused by the capacitive coupling effects thereof are different, which causes the voltage values inputted by the data signal to the gate electrode of the drive TFT to be different, this influences the voltage Vgs between the gate electrode and the source electrode and in turn influences the drive current of the drive TFT. Therefore, changing the gate control signal can change the drive current of the pixel, and in turn can regulate the luminous brightness of the pixel on the display panel.

Figure 2:
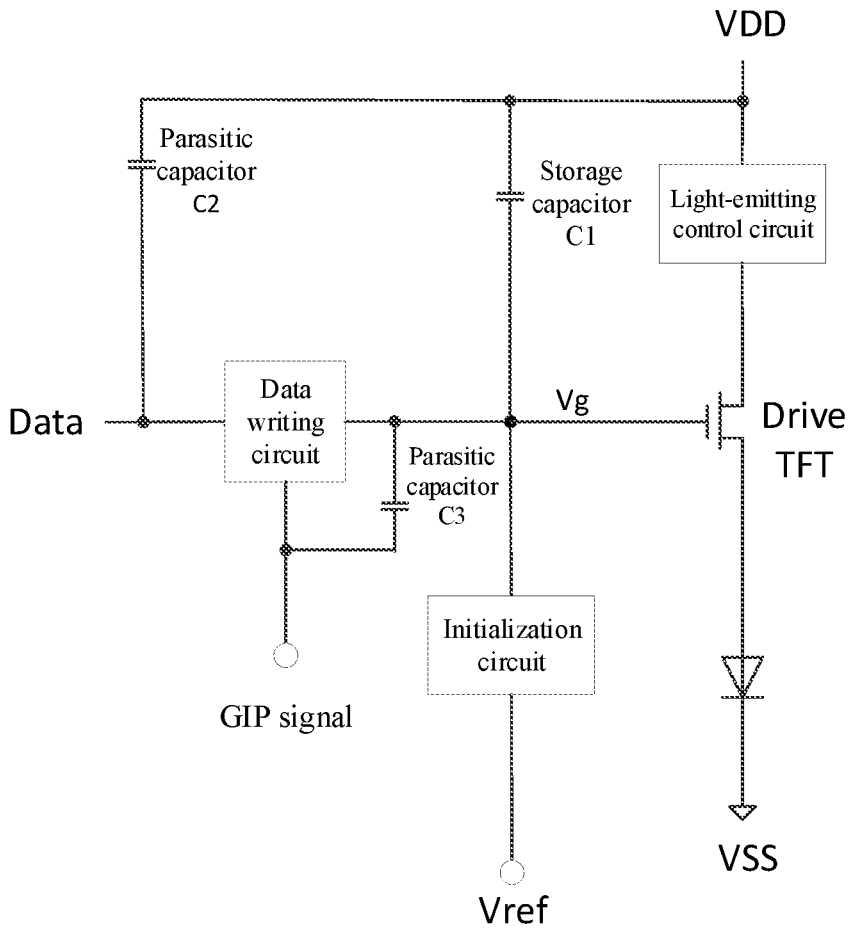
FIG. 2 is a schematic diagram of a pixel circuit in another exemplary embodiment of the present application, adding a Gate-in-Panel (GIP) signal and a corresponding parasitic capacitance C3 on the basis of the pixel circuit of FIG. 1.

FIG. 2 is a schematic diagram of another pixel circuit, which is taken as an example to analyze how the gate control signal influences the luminous brightness of a pixel on a display panel. As shown in FIG. 2, the initialization circuit is turned on, Vref is written into the gate electrode of the drive TFT, the gate voltage equals the initialization voltage, Vg=Vref. The gate control signal, also called the Gate-in-Panel (GIP) signal, changes from a switched-off signal V1 to a switched-on signal V2, the data writing circuit is turned on, the data signal is written into the gate electrode of the drive TFT, Vg=Vdata. Then, the GIP signal changes from the switched-on signal V2 to the switched-off signal V1, the data writing circuit is turned off. Because of the capacitive coupling effect, $$Vg = Vdata + (V1 - V2) \times \frac{C3}{C1 + C2 + C3}.$$

The light-emitting control circuit is turned on, and the OLED device emits light. Because the luminous brightness is controlled by the electric potential of the gate electrode of the drive TFT, and according to the above calculation formula, the electric potential of the gate electrode is influenced by the GIP signal, therefore, the current flowing through the OLED device is influenced by the GIP signal, and the luminous brightness of the pixel on the display panel is influenced by the GIP signal. That is to say, the gate control signal influences the luminous brightness of the pixel.

One exemplary embodiment of the present application provides a drive circuit for a display panel having a slot. The drive circuit can individually regulate the luminance of pixels adjacent to the slot area, so that the luminance of the display panel has good consistency.

Figure 3:
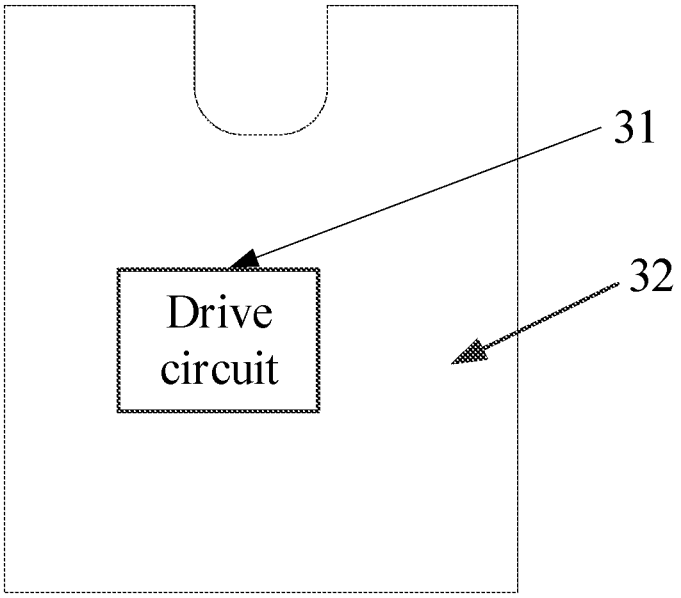
FIG. 3 is a schematic diagram of an application scene in an exemplary embodiment of the present application.

FIG. 3 is a schematic diagram of an application scene in an exemplary embodiment of the present application. The drive circuit 31 is applied in a display panel 32 having a slot, for regulating the luminous brightness of pixels on the display panel 32. As shown in FIG. 3, the slot is provided on an edge of the display panel 32. When manufacturing pixel circuits on the display panel 32 having a slot, the drive circuit 31 in this embodiment is utilized to regulate the luminous brightness of the pixels on the display panel. By configuring the drive signal for pixels in and adjacent to the slot area to be different from the drive signal for pixels in other areas, the problem of luminance non-uniformity (mura) at the joint between the slot area and the non-slot area of the display panel is alleviated.

One exemplary embodiment of the present application provides a drive circuit for a display panel having a slot, comprising:

a first drive line, for regulating luminous brightness of pixels in a row or column where the slot is located, and/or for regulating luminous brightness of pixels in a row or column adjacent to the slot;

a second drive line, for regulating luminous brightness of pixels in a row other than the row regulated by the first drive line, or for regulating luminous brightness of pixels in a column other than the column regulated by the first drive line;

a current applied to the first drive line is different from a current applied to the second drive line, or a voltage applied to the first drive line is different from a voltage applied to the second drive line.

The afore-mentioned drive circuit utilizes the first drive line to individually regulate the luminous brightness of pixels in and adjacent to the slot area on the display panel, which makes the luminance of the entire display panel with the slot have good consistency, so that the uniformity of display is improved, and the problem of luminance non-uniformity (mura) caused by the open slot is prevented.

Optionally, the first drive line and the second drive line are formed in the same process step. This can lessen the process steps and reduce the production cost.

Preferably, the first drive line is formed in the same process step as a control end of a drive transistor or switching transistor in a pixel connected with the first drive line; the second drive line is formed in the same process step as a control end of a drive transistor or switching transistor in a pixel connected with the second drive line.

For example, the first drive line and the second drive line are used to regulate the initialization signal (reset signal) of the drive TFT, and therefore the first drive line and the second drive line are directly connected to the gate electrode (control end) of the drive TFT, as shown in FIG. 1. Accordingly, in an actual manufacturing process, the first drive line and the second drive line are manufactured in the same layer as the gate electrode of the drive TFT, and they may be formed in the same process step. For example, electric conductive material on an entire surface is prepared, the gate electrode and the drive line (including the first drive line and the second drive line) are produced simultaneously by patterning using a mask plate, and electric connection can be established during the manufacturing process in the same layer. This can minimize interlayer interconnection between the gate electrode and the drive line, and in turn can reduce the production cost. In other embodiments, the first drive line and the second drive line may be provided in different layers, or may be provided in the same layer, but different from the layer in which the gate electrode of the drive TFT is provided.

Figure 11:
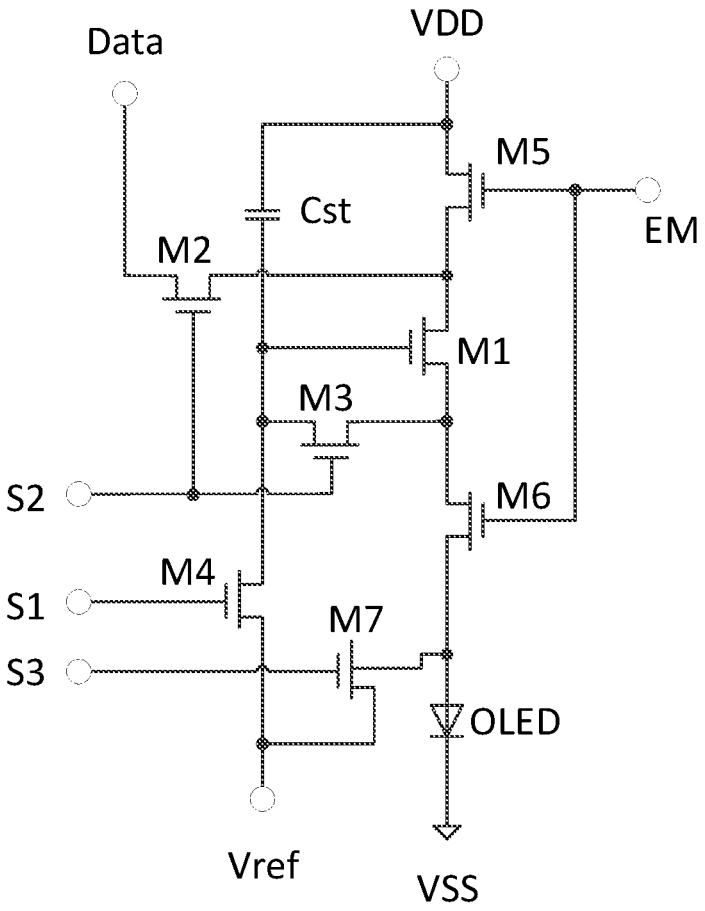
FIG. 11 is a schematic diagram of a 7T1C pixel circuit used in a drive circuit for a display panel having a slot in an exemplary embodiment of the present application.

For another example, the first drive line and the second drive line are used to regulate the gate control signal of the drive TFT. The first drive line and the second drive line regulate the gate voltage of a switching TFT, in order to regulate the gate voltage of the drive TFT. As shown in FIG. 11, by regulating the gate voltage of the switching transistor M3, the gate voltage of the drive transistor M1 can in turn be regulated. In an actual manufacturing process, the first drive line and the second drive line may be manufactured in the same layer as the gate electrode of the switching transistor M3, and they may be formed in the same process step. In other embodiments, the first drive line and the second drive line may be provided in different layers, or may be provided in the same layer, but different from the layer in which the gate electrode of the switching TFT is provided.

Optionally, the first drive line comprises at least two drive lines, the currents applied to the at least two drive lines are the same or different, or the voltages applied to the at least two drive lines are the same or different. The number of drive lines included by the first drive line may depend on the number of rows or columns actually to be regulated thereby, one drive line may individually regulate the luminous brightness of one row or one column of pixels, or may regulate the luminous brightness of multiple rows or multiple columns of pixels, which can be arranged according to demands. A larger number of drive lines leads to more accurate control of the luminous brightness of the pixels. In other alternative embodiments, for convenient regulating, there may be only one drive line provided for regulating the luminous brightness of pixels in and adjacent to the slot area.

Optionally, the second drive line comprises at least one drive line. Preferably, the second drive line comprises at least two drive lines, the currents applied to the at least two drive lines are the same or different, or the voltages applied to the at least two drive lines are the same or different. The number of drive lines included by the second drive line may depend on the number of rows or columns actually to be regulated thereby, one drive line may individually regulate the luminous brightness of one row or one column of pixels, or may regulate the luminous brightness of multiple rows or multiple columns of pixels, which can be arranged according to demands. In other alternative embodiments, in order to facilitate the regulation, there may be only one drive line provided as the second drive line.

When the display panel is scanned up and down along a column direction of pixels, the first drive line is connected to pixels in a row where the slot is located and/or in a row adjacent to the slot.

When the display panel is scanned left and right along a row direction of pixels, the first drive line is connected to pixels in a column where the slot is located and/or in a column adjacent to the slot.

The pixels regulated by the first drive line is related to the scan mode, this is because the scan mode determines the type of mura, up and down scanning would cause mura to occur in the horizontal direction, and left and right scanning would cause mura to occur in the vertical direction. The first drive line regulates pixel row(s) or pixel column(s) according to the scan mode, so that the problem of horizontal mura or vertical mura caused by the open slot is correspondingly avoided.

Figure 4:
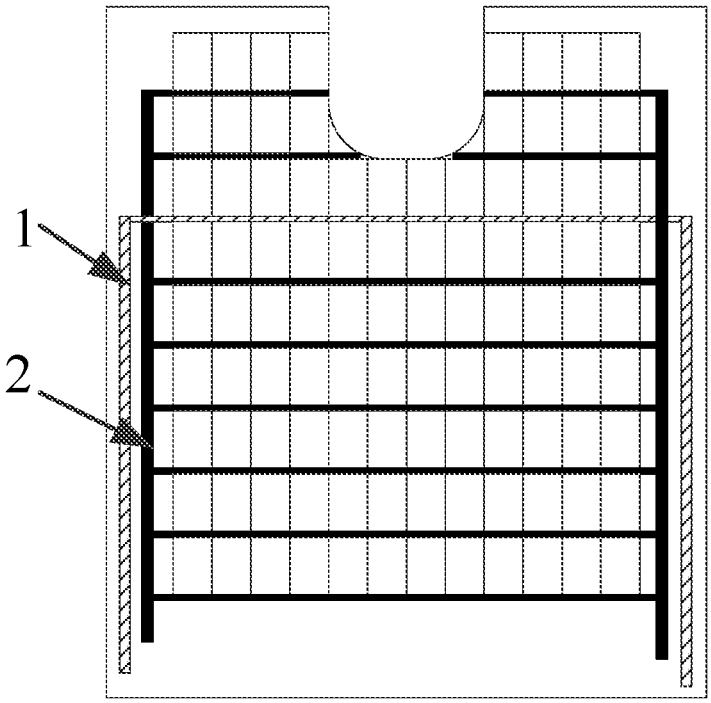
FIG. 4 is a circuit schematic diagram of a drive circuit for a display panel having a slot in an exemplary embodiment of the present application.

Optionally, the first drive line is a first initialization signal line, the second drive line is a second initialization signal line, i.e., by changing the initialization signal, the luminous brightness of pixels in and adjacent to the slot area is individually regulated. FIG. 4 is a schematic diagram of a drive circuit for a display panel having a slot in an exemplary embodiment of the present application. As shown in FIG. 4, the drive circuit for a display panel having a slot provided by this embodiment comprises:

a first initialization signal line 1, for regulating the resetting of pixels in a row or column where the slot is located, and/or for regulating the resetting of pixels in a row or column adjacent to the slot;

a second initialization signal line 2, for regulating the resetting of pixels in a row other than the row regulated by the first initialization signal line 1, or for regulating the resetting of pixels in a column other than the column regulated by the first initialization signal line 1;

wherein a current applied to the first initialization signal line 1 is different from a current applied to the second initialization signal line 2, or a voltage applied to the first initialization signal line 1 is different from a voltage applied to the second initialization signal line 2.

The afore-mentioned drive circuit utilizes the first initialization signal line to regulate the resetting of pixels in a row or column where the slot is located and/or regulate the resetting of pixels in a row or column adjacent to the slot, and utilizes the second initialization signal line to regulate the resetting of pixels in other rows or columns, and by utilizing the first initialization signal line to individually regulate the resetting of pixels in and adjacent to the slot area on the display panel, the luminance of the entire display panel having the slot has good consistency, so that the uniformity of display is improved, and the problem of luminance non-uniformity (mura) caused by the open slot is prevented.

Optionally, when the display panel is scanned up and down, the first initialization signal line is connected to pixels in a row where the slot is located and pixels in a row adjacent to the slot. Normally, the orientation of an initialization signal line is consistent with the orientation of the scan line, and when the scan mode is up and down scanning, the scan line is arranged in the row direction, so the arrangement of the initialization signal line is also in the row direction, and therefore the first initialization signal line is arranged to be connected to pixels in a row where the slot is located and pixels in a row adjacent to the slot. The afore-mentioned up and down scanning only refers to a general scanning direction, and it should be understood by a person skilled in the art that the up and down scanning includes various scanning modes, such as scanning from up to down, or scanning from down to up, or scanning from middle to up and down, and etc.

Figure 5:
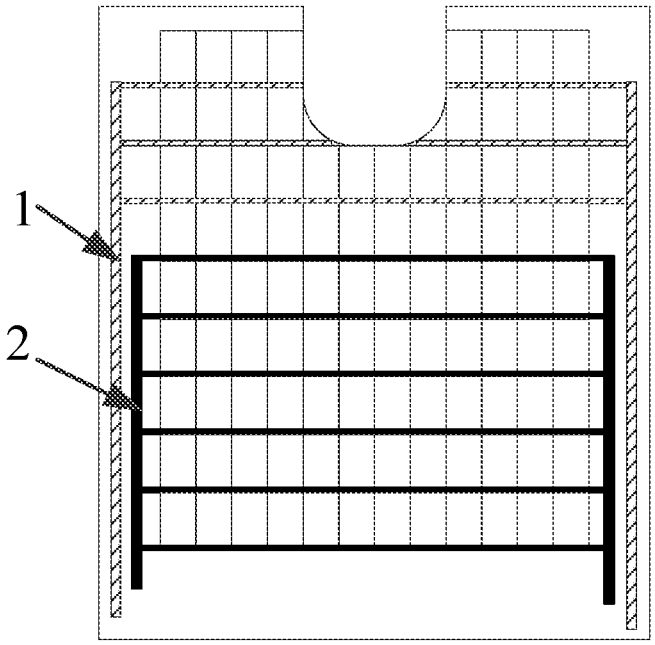
FIG. 5 is a circuit schematic diagram of a drive circuit for a display panel having a slot in another exemplary embodiment of the present application.

Optionally, the scanning mode of the display panel is up and down scanning, and the slot is located on an upper part of the display panel, the first initialization signal line 1 may, as shown in FIG. 4, be connected to the pixels in a row under and adjacent to the slot; the first initialization signal line 1 may also, as shown in FIG. 5, be connected to the pixels in a row under and adjacent to the slot and the pixels in rows where the slot is located. In other embodiments, the rows of pixels to be regulated by the first initialization signal line on the display panel may depend on the particular location of the slot. For example, when the slot is located on a bottom part, the first initialization signal line 1 may regulate the pixels in a row above and adjacent to the slot and/or the pixels in a row where the slot is located. Reasonable arrangements can be made according to demands, and are not redundantly described herein.

Figure 6:
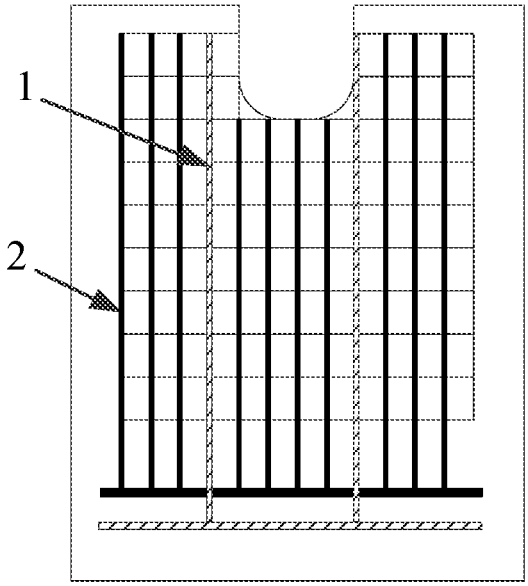
FIG. 6 is a circuit schematic diagram of a drive circuit for a display panel having a slot in yet another exemplary embodiment of the present application.

Optionally, when the display panel is scanned left and right, the arrangement of the initialization signal line is in the column direction, the first initialization signal line is connected to pixels in a column where the slot is located and/or in a column adjacent to the slot. As shown in FIG. 6, the first initialization signal line is connected to pixels in the columns adjacent to the slot. In other embodiments, the first initialization signal line may only be connected to the pixels in the column(s) where the slot is located, or may be connected to both the pixels in the column(s) where the slot is located and the pixels in the columns adjacent to the slot, reasonable arrangements can be made according to demands. The afore-mentioned left and right scanning only refers to a general scanning direction, and it should be understood by a person skilled in the art that the left and right scanning includes various scanning modes, such as scanning from left to right, or scanning from right to left, or scanning from middle to left and right, and etc.

Optionally, the first drive line comprises at least two drive lines, the currents applied to the at least two drive lines are the same or different, or the voltages applied to the at least two drive lines are the same or different. The current or voltage applied to the first drive line is a fixed value, or is a variable value determined according to a gray scale.

When the current or voltage applied to the first drive line is a fixed value, the adjustment is simpler, and the operation is more convenient. When the current or voltage applied to the first drive line is a variable value determined according to a gray scale, the adjustment of the pixel luminance is more flexible and accurate, so the problem of mura can be effectively solved.

Figure 7:
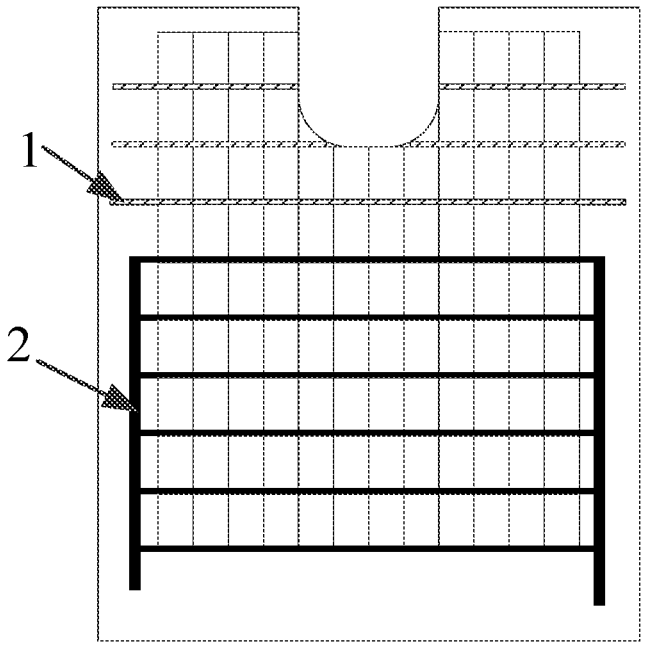
FIG. 7 is a circuit schematic diagram of a drive circuit for a display panel having a slot in still another exemplary embodiment of the present application.

The situation of the first drive line being a first initialization signal line is taken as an example for illustration. As shown in FIG. 7, the pixels in rows where the slot is located and the pixels in a row adjacent to the slot are separately regulated. The first initialization signal line comprises five initialization signal lines, and the currents or voltages applied to each of the initialization signal lines are different, so as to facilitate individual regulation of each row of pixels thereof and adjustment of the luminous brightness of each row of pixels thereof, so that the overall luminous brightness has good consistency. In other embodiments, as shown in FIG. 5, the currents or voltages applied to each of the five initialization signal lines of the first initialization signal line are the same. In such situation, the drive circuit is simpler, and the control of the drive circuit is also simpler.

Figure 8:
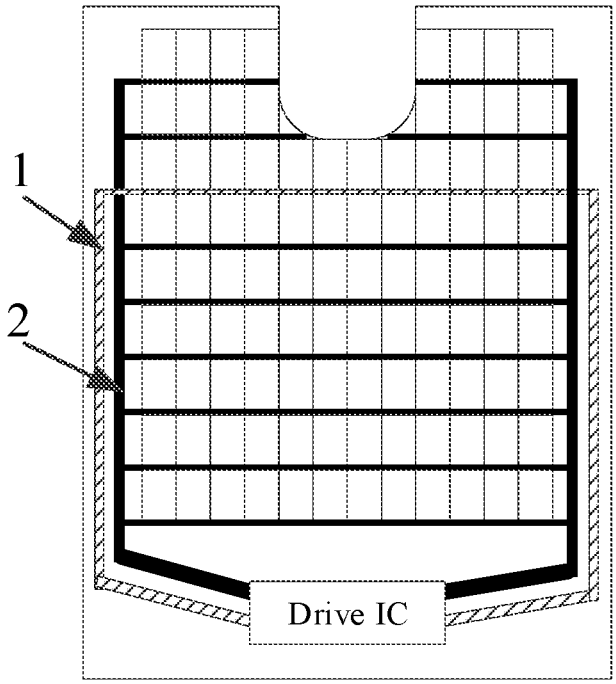
FIG. 8 is a circuit schematic diagram of a drive circuit for a display panel having a slot in yet another exemplary embodiment of the present application.

Optionally, the first drive line is a first initialization signal line 1, and the second drive line is a second initialization signal line 2, the first initialization signal line 1 and the second initialization signal line 2 respectively receive a first initialization signal and a second initialization signal sent from a drive chip (i.e., a drive IC), as shown in FIG. 8.

Optionally, the first initialization signal line 1 and the second initialization signal line 2 are formed in the same process step, this arrangement can save process steps and reduce the production cost. In other embodiments, according to actual needs, the first initialization signal line 1 and the second initialization signal line 2 may also be arranged in different layers.

Optionally, the first initialization signal line 1 and the second initialization signal line 2 are made of material including Mo, Al, Cu, Ti, ITO, Ag or Nb. In other embodiments, according to actual needs, the first initialization signal line 1 and the second initialization signal line 2 may also be made of other electric conductive materials, such as indium zinc oxide (IZO), etc.

Optionally, when the drive circuit comprises seven P-type metal oxide semiconductor thin-film-transistors and one capacitor (i.e., the drive circuit is a PMOS 7T1C circuit) and the first drive line is a first initialization signal line, the fixed value is in a range of −6V to 0V.

The value of the first initialization signal (first reset signal) can be obtained by testing a display panel actually in use. By conducting lots of tests on test samples, the value of the first reset signal can be determined. Because the test samples and the products (display panels) are produced in the same batch, the process parameters and device structures of the two are the same, the mura that would occur therein is the same, and the adjustment amount for the reset signal is also the same, therefore, according to the value of the reset signal acquired by the tests, the value of the first initialization signal can be obtained.

Figure 9:
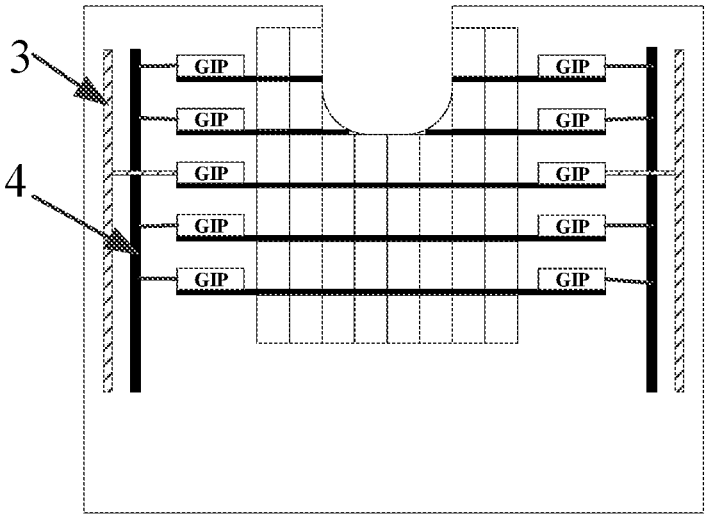
FIG. 9 is a circuit schematic diagram of a drive circuit for a display panel having a slot in still another exemplary embodiment of the present application.

Optionally, the first drive line is a first gate control signal line, and the second drive line is a second gate control signal line, i.e., by changing the gate control signal, the luminous brightness of pixels in and adjacent to the slot area is individually regulated. FIG. 9 is a schematic diagram of a specific exemplary drive circuit for a display panel having a slot in this embodiment. As shown in FIG. 9, the drive circuit for a display panel having a slot provided by this embodiment comprises:

a first gate control signal line 3, for regulating the gate potential of pixels in a row or column where the slot is located, and/or for regulating the gate potential of pixels in a row or column adjacent to the slot;

a second gate control signal line 4, for regulating the gate potential of pixels in a row other than the row regulated by the first gate control signal line 3, or for regulating the gate potential of pixels in a column other than the column regulated by the first gate control signal line 3;

wherein a current applied to the first gate control signal line 3 is different from a current applied to the second gate control signal line 4, or a voltage applied to the first gate control signal line 3 is different from a voltage applied to the second gate control signal line 4.

The afore-mentioned drive circuit utilizes the first gate control signal line to individually regulate the gate potential of pixels in and adjacent to the slot area on the display panel, which makes the luminance of the entire display panel with the slot have good consistency, so that the uniformity of display is improved, and the problem of luminance non-uniformity (mura) caused by the open slot is avoided.

Optionally, the scanning mode of the display panel is up and down scanning, and the slot is located on an upper part of the display panel, as shown in FIG. 9, the first gate control signal line is connected to the pixels in a row under and adjacent to the slot. In other embodiments, according to needs, the first gate control signal line may also be connected to the pixels in rows where the slot is located, or may be connected to both the pixels in rows where the slot is located and the pixels in a row under and adjacent to the slot. The location of the row(s) of pixels to be regulated by the first gate control signal line on the display panel may depend on the particular location of the slot. For example, when the slot is located on a bottom part, the first gate control signal line may regulate the pixels in a row above and adjacent to the slot and/or the pixels in a row where the slot is located. Reasonable arrangements can be made according to the demands, and are not exhaustively listed one by one herein. The afore-mentioned up and down scanning only refers to a general scanning direction, which should be understood by a person skilled in the art to include various scanning modes, such as scanning from up to down, or scanning from down to up, or scanning from middle to up and down, and etc.

In other embodiments, the scanning mode of the display panel is left and right scanning, the arrangement of the gate control signal line is in the column direction, the first gate control signal line is connected to pixels in a column where the slot is located and/or in a column adjacent to the slot. The afore-mentioned left and right scanning only refers to a general scanning direction, which should be understood by a person skilled in the art to include various scanning modes, such as scanning from left to right, or scanning from right to left, or scanning from middle to left and right.

Optionally, the first gate control signal line comprises at least two gate control signal lines, the currents applied to the at least two gate control signal lines are the same or different, or the voltages applied to the at least two gate control signal lines are the same or different. The current or voltage applied to the first gate control signal line is a fixed value, or is a variable value determined according to a gray scale. The number of the afore-mentioned first gate control signal line, as well as the value of voltage or current applied to the gate control signal line, can be reasonably arranged according to actual needs, which is not limited to this embodiment.

Figure 10:
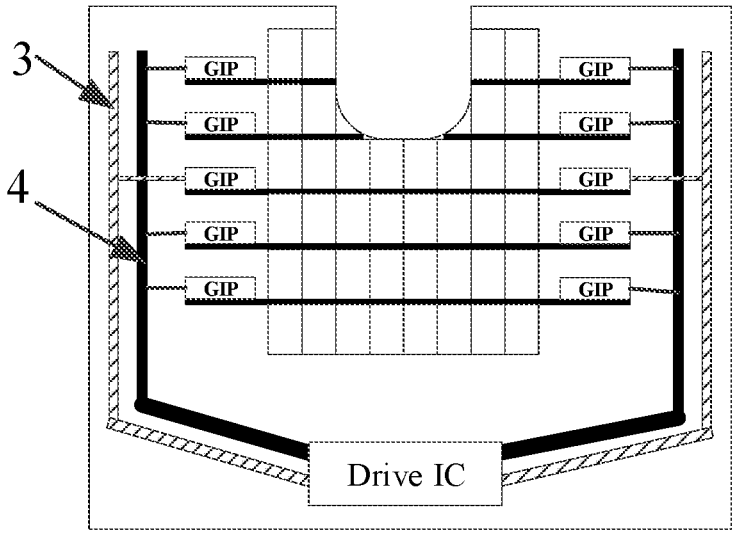
FIG. 10 is a circuit schematic diagram of a drive circuit for a display panel having a slot in yet another exemplary embodiment of the present application.

Optionally, the first gate control signal line and the second gate control signal line respectively receive a first gate control signal and a second gate control signal sent from a shift-register circuit. As shown in FIG. 10, the shift-register circuit may be a GIP (Gate-in-Panel) circuit. In other embodiments, according to needs, other shift-register circuits may also be used.

In accordance with the above description of the method for testing and determining the value of the first initialization signal, the value of the first gate control signal may also be obtained by testing a display panel actually in use. And by conducting lots of tests on test samples, the value of the first gate control signal can be determined.

FIG. 11 shows a 7T1C pixel circuit of a drive circuit in one embodiment. Specifically, by using the first gate control signal line, the S2 signal for the pixels in a row under and adjacent to the slot can be individually regulated, so as to adjust the luminous brightness of this row of pixels to make the luminance of this row consistent with the luminance of the entire screen, thereby solving the problem of horizontal mura. In other embodiments, any technical solutions with the concept of determining the gate control signal according to the pixel circuit actually in use and changing the gate potential by changing the gate control signal all fall into the protection scope of the present application.

The present application also provides a display screen, comprising a display panel having a slot and the drive circuit for a display panel according to any of the afore-mentioned embodiments.

The afore-mentioned drive circuit is applied on a display panel having a slot, the drive circuit regulates the luminous brightness of the pixels thereof, so as to make the luminous brightness of all the pixels on the display panel have good consistency, thereby significantly alleviating the problem of luminance non-uniformity (mura) in and adjacent to the slot area, and thus improving the luminance uniformity of the display panel having a slot.

Optionally, the slot is located on an upper part of the display panel, as shown in FIG. 4. In other embodiments, the slot may also be located on a lower part or a middle part of the display panel. The location of the slot on the display panel may be arranged according to actual needs, and the shape, size and location of the slot are not limited in any way by the present embodiment.

The present application also provides a display device, comprising the display screen mentioned in any of the above embodiments. The display device may be any product or component having a display function, such as a cellphone, a tablet, a TV-set, a display, a palm computer, an iPod, a digital camera, a GPS navigator, etc.

Although the embodiments of the present application are described with reference to the appended drawings, a person skilled in the art may make various changes and modifications without departing from the concept and scope of the present application, and these changes and modifications also fall into the scope defined by the appended Claims.

The invention claimed is:

1. A drive circuit for a display panel having a slot, comprising:

a first drive line, for regulating luminous brightness of pixels in a row or column where the slot is located, and/or for regulating luminous brightness of pixels in a row or column adjacent to the slot; and a second drive line, for regulating luminous brightness of pixels in a row other than the row regulated by the first drive line, or for regulating luminous brightness of pixels in a column other than the column regulated by the first drive line;

wherein, a current applied to the first drive line is different from a current applied to the second drive line, or a voltage applied to the first drive line is different from a voltage applied to the second drive line, wherein, the first drive line comprises at least two drive lines, the currents applied to the at least two drive lines are different, or the voltages applied to the at least two drive lines are different, wherein, the first drive line is a first initialization signal line, the second drive line is a second initialization signal line;

the first initialization signal line is used for regulating the resetting of pixels in the row or column where the slot is located, and/or for regulating the resetting of pixels in the row or column adjacent to the slot;

the second initialization signal line is used for regulating the resetting of pixels in a row other than the row regulated by the first initialization signal line, or for regulating the resetting of pixels in a column other than the column regulated by the first initialization signal line.

2. The drive circuit for a display panel having a slot according to claim 1, wherein, when the display panel is scanned along a column direction of pixels, the first drive line is connected to pixels in the row where the slot is located and/or in the row adjacent to the slot.

3. The drive circuit for a display panel having a slot according to claim 1, wherein, when the display panel is scanned along a row direction of pixels, the first drive line is connected to pixels in the column where the slot is located and/or in the column adjacent to the slot.

4. The drive circuit for a display panel having a slot according to claim 1, wherein, the first initialization signal line and the second initialization signal line respectively receive a first initialization signal and a second initialization signal sent from a drive chip.

5. The drive circuit for a display panel having a slot according to claim 1, wherein, the first drive line is a first gate control signal line, the second drive line is a second gate control signal line;

the first gate control signal line is used for regulating the gate potential of pixels in the row or column where the slot is located, and/or for regulating the gate potential of pixels in the row or column adjacent to the slot;

the second gate control signal line is used for regulating the gate potential of pixels in a row other than the row regulated by the first gate control signal line, or for regulating the gate potential of pixels in a column other than the column regulated by the first gate control signal line.

6. The drive circuit for a display panel having a slot according to claim 5, wherein, the first gate control signal line and the second gate control signal line respectively receive a first gate control signal and a second gate control signal sent from a shift-register circuit.

7. The drive circuit for a display panel having a slot according to claim 1, wherein, the current or voltage applied to the first drive line is a fixed value.

8. The drive circuit for a display panel having a slot according to claim 1, wherein, the current or voltage applied to the first drive line is a variable value determined according to a gray scale.

9. The drive circuit for a display panel having a slot according to claim 7, wherein, when the drive circuit comprises seven P-type metal oxide semiconductor thin-film-transistors and one capacitor and the first drive line is a first initialization signal line, the fixed value is in a range of −6V to 0V.

10. The drive circuit for a display panel having a slot according to claim 1, wherein, the first drive line and the second drive line are formed in the same process step.

11. The drive circuit for a display panel having a slot according to claim 1, wherein, the first drive line is formed in the same process step as a control end of a drive transistor or a switching transistor in a pixel connected with the first drive line; and/or the second drive line is formed in the same process step as a control end of a drive transistor or a switching transistor in a pixel connected with the second drive line.

12. The drive circuit for a display panel having a slot according to claim 1, wherein, the first initialization signal line and the second initialization signal line are made of material selected from Mo, Al, Cu, Ti, ITO, IZO, Ag or Nb.

13. The drive circuit for a display panel having a slot according to claim 6, wherein, the shift-register circuit is a Gate-in-Panel circuit.

14. The drive circuit for a display panel having a slot according to claim 1, wherein, the second drive line comprises at least two drive lines, the currents applied to the at least two drive lines are the same or different, or the voltages applied to the at least two drive lines are the same or different.

15. A display screen, comprising:

a display panel having a slot; and the drive circuit for a display panel according to claim 1.

16. The display screen according to claim 15, wherein, the slot is located on an edge of the display panel.

17. A display device, comprising the display screen according to claim 15.

* * * * *